United States Patent [19]

Walker

[11] 4,091,726

[45] May 30, 1978

[54] MAGNETIC REGISTRATION APPARATUS FOR SILK SCREEN PRINTER

[75] Inventor: Howard R. Walker, Aldan, Pa.

[73] Assignee: Joseph E. Podgor, Inc., Pennsauken, N.J.

[21] Appl. No.: 738,318

[22] Filed: Nov. 2, 1976

[51] Int. Cl.[2] ..... B41F 17/20

[52] U.S. Cl. ..... 101/38 A; 101/126; 198/394

[58] Field of Search ..... 101/126, 115, 38 R, 101/38 A, 39, 40; 198/381, 394

[56] References Cited

U.S. PATENT DOCUMENTS

| | | | |
|---|---|---|---|
| 2,679,918 | 6/1954 | Vargo et al. | 198/381 |
| 3,880,074 | 4/1975 | Seifert | 101/126 X |
| 3,887,997 | 6/1975 | Hartleroad | 198/381 X |

*Primary Examiner*—Ronald E. Suter
*Attorney, Agent, or Firm*—Stanley Bilker

[57] ABSTRACT

Automatic registration apparatus for multi-color silk screening of elongated articles, such as writing implements, includes a carriage for rotatably supporting the articles with respect to the longitudinal axis thereof and magnetic means on the carriage for drawing a magnetically attractable index on the article, for example a pocket clip, so that a surface on the article is oriented in predetermined disposition with a pattern in the silk screen stencil. The carriage is also adapted to lift the articles from a high speed conveyor into contact with the silk screen stencil.

10 Claims, 3 Drawing Figures

MAGNETIC REGISTRATION APPARATUS FOR SILK SCREEN PRINTER

FIELD OF THE INVENTION

This invention relates to silk screen printing apparatus, and more particularly relates to an automatic registration system for precisely orienting the surface of elongated articles, such as writing implements, with respect to a pattern in the silk screen stencil so that multi-color designs may be separately imprinted on such surface in predetermined disposition with each other. This invention is especially related to a magnetic registration system for positioning articles having a surface symmetrically disposed about an axis, for example, pens, pencils, pipettes, burettes, thermometers, bottles, ampoules, and other cylindrical objects so that a pattern may be imprinted on such articles in precise orientation with respect to a magnetic index pre-configured thereon. Such a registration system is particularly useful in silk screen printing of multi-colored designs on pens and pencils and in applying volumetric capacity indicia in precise registration with precalibrated markings on cylindrical objects, such as thermometers, burettes and pipettes.

BACKROUND OF THE INVENTION

During the silk screening of elongated or cylindrical objects, it is frequently desirable to apply a multi-color design to the surface of such articles such that elements of the design are in exact registration with each other or to incorporate volumemetric capacity data in precise registration with precalibrated indicia on cylindrical objects, such as temperature or volume measuring instruments. However, in order to assure that multi-color designs are in registration with each other or in order to insure that certain indicia be superimposed upon precalibrated markings, it is necessary to key the respective patterns in predetermined disposition with an index point on the article.

In the past, various mechanical, electrical and optical triggering devices were employed to trip the printing mechanism when a predetermined index position was reached on the object or workpiece. All of these prior systems required deliberate externally applied rotation of the object at the tripping station, and, as such, necessitated unduly expensive sensing and cooperative motion-imparting mechanisms to insure that the proper orientation was achieved.

It is therefore an object of this invention to provide an automatic registration system for precisely orienting a predetermined position on the surface of an elongated article with respect to an indexing point thereon.

Another object of this invention is to provide a magnetic registration system for orienting a predetermined position on the surface of an elongated article wherein the article will automatically be drawn into correct configuration without the use of external motors or actuation devices.

Still another object of this invention is to provide an automatic registration system for multi-color silk screening of elongated articles wherein the articles may rapidly be drawn into proper disposition with respect to a pattern of a silk screen stencil at a work station of high speed production conveyor.

Yet another object of this invention is to provide a magnetic registration system for multi-color silk screening of elongated articles whereby the magnetic forces perform both the rotation and indexing of such articles.

A further object of this inention is to provide a magnetic registration system for multi-color silk screening of elongated articles which lends itself to great facility in adjustment and set-up.

Other objects of this invention are to provide an improved device of the character described which is easily and economically produced, sturdy in construction, and highly efficient and effective in operation.

BRIEF DESCRIPTION OF THE DRAWINGS

With the above and related objects in view, this invention consists of the details of construction and combination of parts as will be more fully understood from the following detailed description when read in conjunction with the accompanying drawings, in which.

DETAILED DESCRIPTION OF THE INVENTION

Figure 1:
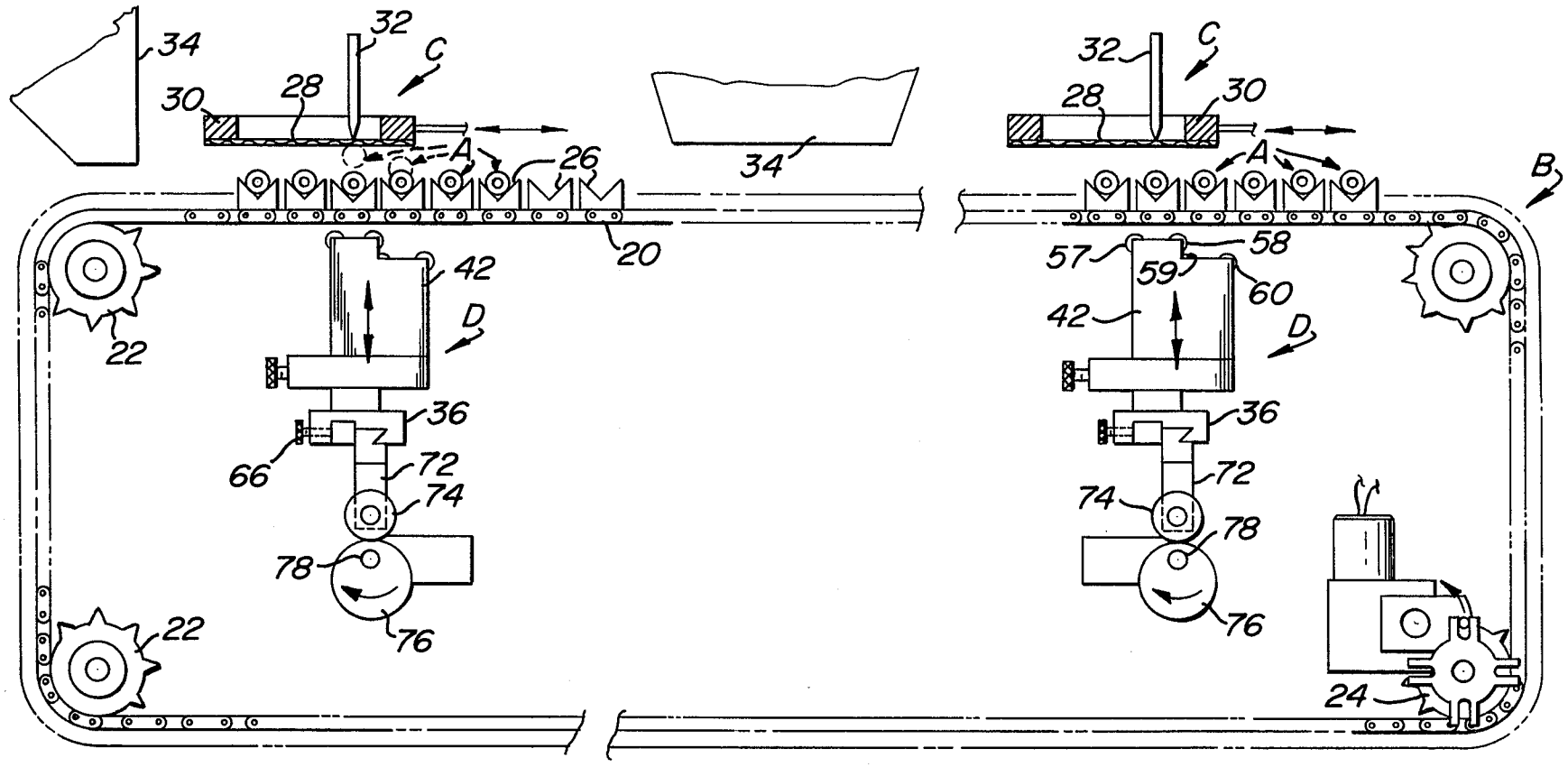
FIG. 1 is a side elevational view of an apparatus for multi-color silk screening of elongated articles and including an automatic registration system embodying this invention.
Figure 2:
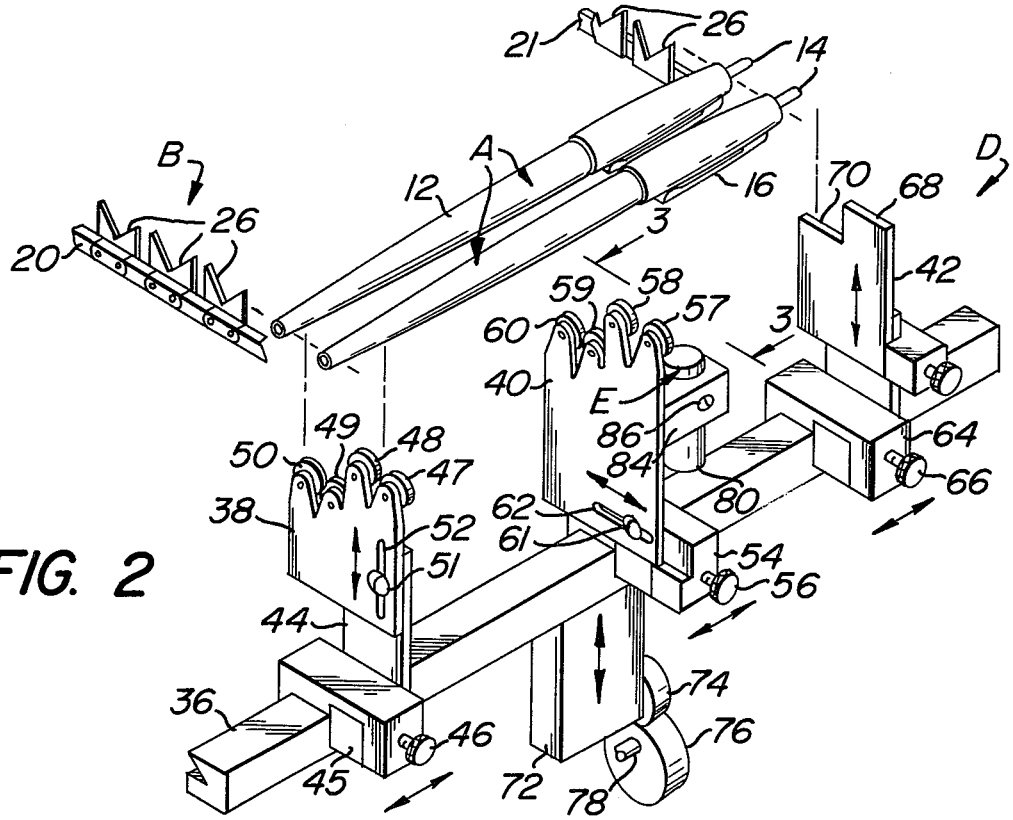
FIG. 2 is a fragmentary perspective view of the registration carriage for lifting articles from a conveyor into aligned orientation with the pattern in the silk screen stencil.

Referring now in greater detail to the drawings in which similar reference characters refer to similar parts, I show an automatic silk screen apparatus for the multi-color imprinting of cylindrical objects, generally designated as A, such that each color design is oriented in precise registration with the previous color pattern. The apparatus includes a conveyor, generally designated as B, a silk screen mechanism, generally designated as C, which is mounted above the conveyor, and a carriage, generally designated as D, for lifting the articles A from the conveyor into abutment with the silk screen mechanism. Magnetic means E on the carriage produces a pull upon a magnetically attractable index on the article A in said carriage to effect rotation thereof into precise disposition with respect to a pattern in the silk screen stencil.

The articles A as shown comprise, for example, ball point pens having a plastic or non-magnetic metal body portion 12, a push button 14 for actuating an internal ink cartridge (not shown) and a clip 16 for attachment of the pen to a person's pocket. The clip 16 is of a magnetically attractable metal, such as steel, and constitutes the magnetic index which is drawn by the magnetic means E to effect rotation of the pen in the carriage D into exact alignment with the silk screen pattern C. However, if the articles A did not already include such clips 16, a stripe or dot of a magnetically attractable member or coating could be incorporated at a point opposite the surface to which the silk screen printing is applied.

The conveyor B comprises a pair of continuous chains 20 and 21 which are laterally spaced from each other and carried by suitable sprockets 22. A Geneva drive 24 or a pawl drive effects periodic rotation of the drive sprocket so that the chains 20 and 21 advance intermittently at regular intervals with a dwell or pause in each cycle. A plurality of V-notched holding elements 26 are attached to each of the chains 20 and 21 and support the elongated articles carried in the conveyor B. A suitable article dispenser (not shown), such as a walking beam mechanism deposits the articles A into the holding elements 26 at the rate of approximately 80 per minute so that they may be imprinted at that speed. The chains 20 and 21 may be slanted from each other laterally or a guide rail (not shown) may urge the articles transversely until the shoulder of the body portion 12 adjacent the pushbutton 14 is pressed toward the chain element 21, for example.

The silk screen apparatus C is conventional and includes a stencil 28 incorporating the foraminous pattern and which is stretched across the bottom of a frame 30. The frame 30 is longitudinally displacable in a housing (not shown) above the conveyor B and is reciprocable by a suitable mechanism which is timed to the dwell of the chains. A fixed spatula or squeegee 32 abuts against the upper surface of the stencil 28 and presses the colored ink contained thereon through the pores of the pattern. Two or more silk screen printing mechanisms C may be longitudinally spaced from each other above the conveyor B with an air blown or infrared heater 34 mounted after each silk screen to effect drying of each color pattern applied to the articles A before imprinting of the next color pattern.

One carriage D is vertically reciprocable below each silk screen mechanism C and is adapted to lift the articles A from the transporting elements 26 into contact with the stencil 28 during the dwell portions of the conveying cycle. Each carriage D includes a transverse bar 36 which slidably supports laterally spaced carrying cradles 38 and 40 and lateral guide rest 42. Cradle 38 comprises a plate which is vertically adjustable on post 44 whose position is locked to transverse bar 36 by clamping block 45 and knurled thumb screw 46. A pair of rollers 47 and 48 are journaled at an upper level of cradle 38 while a second pair of rollers 49 and 50 are rotatably journaled at a slightly lower level. Set screw 51 slidably retained in slot 52 affixes the vertical disposition of cradle 38 with respect to post 44. Cradle 40 includes a horizontally adjustable plate which is carried on clamping block 54, the latter being affixed to transverse bar 36 by means of thumb screw 56. A pair of rollers 57 and 58 are journaled at an upper level of cradle 40 so that they are adapted to be aligned with rollers 47 and 48. A second pair of rollers 59 and 60 are journaled at a second level in cradle 40 so that they may be aligned with rollers 49 and 50. Set screw 61 is horizontally disposed in slot 62 for adjustment of cradle 40 in a horizontal direction. Guide rest 42 constitutes an end plate which is vertically and horizontally adjustable with respect to clamping block 64, the latter being affixed in position on the transverse bar 36 by means of knurled locking screw 66. An upper edge 68 of rest 42 corresponds to the upper level or rollers 47–48 and 57–58 while notched edge 70 corresponds to the second level of the rollers 49–50 and 59–60. The upper level constitutes the silk screen printing stage while the lower level constitutes a prealignment stage.

The carriage D includes a leg 72 which depends from the medial portion of transverse bar 36. A cam follower roller 74 is rotatably supported at the lower portion of leg 72 and contacts the surface of lifter cam 76 eccentrically coupled to actuating shaft 78. Suitable lateral guide members (not shown) slidably retain the carriage D for reciprocable vertical movement thereof so that rotation of said cam 76 causes lifting of said carriage D whereby articles carried at the upper level are pressed into contact with the underbelly of stencil 28.

Figure 3:
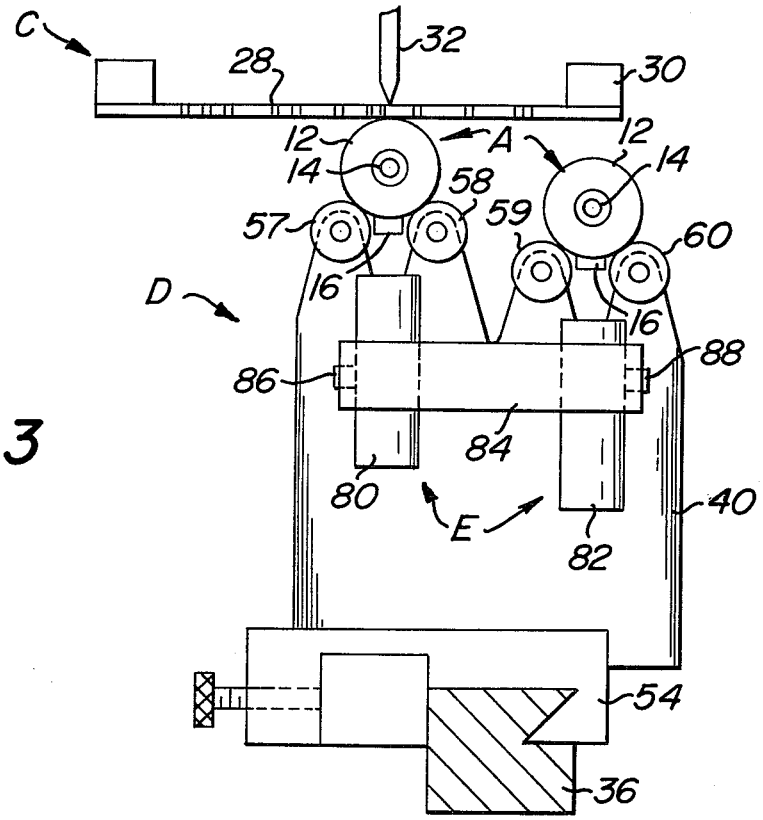
FIG. 3 is a sectional view taken along lines 3—3 of FIG. 2.

The magnetic means E comprise a pair of rod-shaped magnets 80 and 82 which are retained in bracket 84 on cradle 40 by means of suitable set screws 86 and 88. The magnets may be of the Alnico permanent type or electromagnets. Magnet 80 is maintained at a vertical position which is adjacently spaced from the clips 16 when the articles A are cradled in the bight of the upper level rollers 47–48 and 57–58. See FIG. 3. Similarly, magnet 82 is adjusted at a vertical position which is adjacently spaced from the clip 16 when the articles are cradled in lower level rollers 49–50 and 59–60.

The magnet 82 constitutes a pre-aligning station to effect rotation of the articles A, final rotation being effected the next time such article is picked up in the carriage D within the printing station 80. Thus, each article is picked up twice within each carriage D whereby preliminary alignment may be effected during the first lift during the dwell, after which the article is finally aligned during the lift of the next dwell period when it is elevated into contact with the silk screen stencil 28. Lateral alignment of the articles A along the longitudinal axis thereof is maintained by the edge rests 68 and 70.

During the printing stroke of each dwell period, the silk screen mechanism is horizontally reciprocated so that the stencil 28 in contact with the article surface rolls said article in the elevated carriage D while the stationary squeegee 32 forces the ink through the pores of the pattern. Since the article in the carriage D has been rotated by the magnetic pull by the magnets upon the clip 16, the surface opposite will be in precise orientation with the pattern of the silk screen and in alignment with the previous design imprinted thereon.

Although this invention has been described in considerable detail, such description is intended as being illustrative rather than limiting since the invention may be variously embodied without departing from the spirit thereof, and the scope of the invention is to be determined as claimed.

What is claimed is:

1. Apparatus for precisely registering and operating on elongated articles with respect to a silk screen stencil where such articles include a surface symmetrically disposed about the longitudinal axis thereof and a magnetically attractable index contained thereupon, comprising:

carriage means for rotatably supporting said articles with respect to the longitudinal axis, magnetic means secured to said carriage means for attracting the index and causing rotation of each article until a predetermined portion on the surface thereof is in alignment with a pattern on the silk screen stencil, said magnetic means being positionally located in fixed relation to said carriage means to provide spaced disposition between said magnetic means and said index throughout said registration and subsequent operations on said articles, and means to reciprocate said carriage means and said stencil with respect to each other until the surface of said articles abuts said stencil, whereby the stencil may imprint a pattern on each article without interference.

2. The apparatus of claim 1 wherein said carriage means includes pairs of longitudinally spaced rollers for engagement with the surface of said articles.

3. The apparatus of claim 2 including a conveyor means for transporting said articles one at a time to a position over said carriage means, and said means to reciprocate causes said carriage means to lift said articles one at a time up from said conveyor means and into contact with said silk screen stencil.

4. The apparatus of claim 3 wherein said conveyor means comprises a pair of laterally spaced chains transporting said articles transversely to the longitudinal axes thereof.

5. The apparatus of claim 4 wherein said conveyor means is intermittently actuated in regularly spaced intervals.

6. The apparatus of claim 5 wherein a plurality of silk screen stencils are longitudinally spaced along said conveyor means, and one carriage means being mounted opposite each of said silk screen stencils.

7. The apparatus of claim 5 wherein said carriage means is reciprocated during the dwell period of said conveyor means.

8. The apparatus of claim 7 wherein said carriage means includes a preliminary alignment stage and a printing stage.

9. The apparatus of claim 8 wherein said preliminary stage includes pairs of spaced rollers oriented at a lower level from the rollers of said printing stage.

10. Apparatus for precisely registering elongated articles with respect to a silk screen stencil where such articles include a surface symmetrically disposed about the longitudinal axis thereof and a magnetically attractable index contained thereupon, comprising:

carriage means for rotatably supporting said articles with respect to the longitudinal axis, magnetic means on said carriage means for attracting the index and causing rotation of each article until a predetermined portion of the surface thereof is in alignment with a pattern on the silk screen stencil, and means to reciprocate said carriage means and said stencil with respect to each other until the surface of said articles abuts said stencil, said carriage means including a preliminary alignment stage and a printing stage, said preliminary stage including pairs of spaced rollers oriented at a first level and said printing stage including sets of spaced rollers oriented at a second level above the first level.

* * * * *